United States Patent [19]

Carbonell et al.

[11] 3,938,247

[45] Feb. 17, 1976

[54] SHAVING SYSTEM WITH PIVOTAL HEAD

[75] Inventors: Nelson P. Carbonell, Lawrence; Roger L. Perry, Lynnfield Center, both of Mass.

[73] Assignee: The Gillette Company, Boston, Mass.

[22] Filed: Mar. 5, 1974

[21] Appl. No.: 448,243

[52] U.S. Cl. ..... 30/47; 30/50; 30/57

[51] Int. Cl.[2] ..... B26B 21/22

[58] Field of Search ..... 30/38, 50, 57, 85, 87, 30/47

[56] References Cited

UNITED STATES PATENTS

| | | | |
|---|---|---|---|
| 614,049 | 11/1898 | Greenfield | 30/87 X |
| 1,089,726 | 3/1914 | Sharpnack | 30/87 X |
| 3,396,464 | 8/1968 | Treiss | 30/87 X |
| 3,593,416 | 7/1971 | Edson | 30/50 |
| 3,685,150 | 8/1972 | Risher | 30/57 X |
| 3,740,841 | 6/1973 | Risher | 30/57 X |

*Primary Examiner*—Al Lawrence Smith
*Assistant Examiner*—Gary L. Smith

[57] ABSTRACT

A shaving implement includes a grip portion, a transversely extending support portion at one end of the grip portion, a connection between the grip portion and the support portion which permits movement of the support portion relative to the grip portion during the course of a shaving stroke in a dynamic mode of shaving action, and structure for restricting the movement of the support portion relative to the grip portion, the movement restricting structure including a control portion movable between a first position which affords significant movement restriction and a second position which affords less movement restriction.

20 Claims, 13 Drawing Figures

12
176
16
131
24
134
174
180
172
138
170
128
136
166
164
178A
169
168
182
120
44
100
68
62
60
150
30
80

12
176
16
18
24
180
174
134
V
IV
172
128
92
178B
170
110
88
178
178A
182
120
136
VI
128
70
V
VI
66
100
62
90
60
72
IV
80
84
40
82
32
10
36
30
150
38
152
154
14

12
176
164
169
24
166
168
180
174
172
170
178B
128
16
131
134
182
138
120
128
44
100
68
62
60
150
30
80

SHAVING SYSTEM WITH PIVOTAL HEAD

SUMMARY OF INVENTION

This invention relates to wet shaving systems and more particularly to a shaving implement of the type that has a grip portion and a head portion that carries one or more blade elements.

At the present time the majority of shavers employ a shaving implement that has a grip portion and carries one or more blade elements that extend generally transversely to the grip portion. Shaving implements of this type include a variety of configurations, for example, a system in which a single or double edge blade is inserted into a holder by the user; a system employing a cartridge which holds a length of band blade, the user advancing successive lengths of the band for shaving; and a system in which a blade unit has a blade element permanently secured to a guard structure. In such shaving implements, the blade element and cooperating leading and following skin engaging surfaces define a set of shaving geometry relationships.

Continuing efforts are being made to improve the shaving characteristics of such implements and/or to accommodate individual preferences. A factor in shaving efficiency and effectiveness is the orientation of the active components of the shaving system relative to the skin surface being shaved. That surface frequently has undulations or is a relatively inaccessible or awkward area to reach and the shaving action is reduced in efficiency because the relationship of the active elements to the skin surface being shaved significantly departs from the optimum value.

It has been proposed to improve the shaving action by providing a shaving implement in which the active portions of the shaving system are movable relative to the grip portion of the implement and conformable or responsive to the surface of the skin being shaved and it is an object of this invention to provide a novel and improved shaving implement which allows a dynamic mode of shaving action.

Another object of the invention is to provide a novel and improved shaving implement which incorporates this dynamic shaving action feature and that is relatively easy and economical to manufacture and is sturdy and reliable in use.

Still another object of the invention is to provide a novel and improved shaving implement which incorporates controlable restriction of the movement of the support relative to the grip portion.

Another object of the invention is to provide a novel and improved shaving implement that provides a balanced, sturdy, shaving system that provides increased shaving efficiency and effectiveness.

In accordance with the invention there is provided a shaving implement that includes a grip portion and a transversely extending blade support portion at one end of the grip portion. This support structure may have one or more blade elements and cooperating skin engaging structures permanently secured to it, or may be arranged to receive a replaceable blade or blade unit, for example an element of plastic material which has a blade element permanently secured to provide a fixed geometrical relationship between a guard surface and the cutting edge of the blade element, and the blade element or elements may be of the strip type movable relative to the guard elements. The support structure is connected to the grip portion by a joint that permits movement of the support structure relative to the grip portion as a function of dynamic shaving action. Controllable movement restricting structure enables the movement of the support relative to the grip to be modified.

In preferred embodiments the joint structure constrains movement of the support structure relative to the grip portion about an axis of rotation located in the immediate vicinity of the cutting edge or edges and extending parallel thereto. In particular embodiments this movement defining structure includes juxtaposed, spaced, inner and outer, arcuate bearing segments, each bearing segment being less than 180° in angular extent, and a cooperating hollow shaft segment also of less than 180° in angular extent, the inner and outer surfaces of which are received in bearing engagement between the juxtaposed bearing segments, the bearing structure defining a predetermined path of low frictional resistance over the allowed range of movement. Restoring structure housed within the bearing structure tends to maintain the support and grip in normal or neutral relation but yields easily to rotational forces imposed during a shaving stroke. In particular embodiments the restoring structure includes a pair of elongated leaf spring members, the biasing forces of which are equal and opposed when the support portion-grip portion relation is in its normal or neutral position. The biasing force imposed by one of the spring elements as the system moves from its normal or neutral position is of low magnitude so that dynamic action is maximized. The restoring structure may be arranged to impose a restoring force of increasing magnitude as the system departs from its neutral or normal condition. Positive stop structure may be employed to limit the permitted departure from the neutral position.

The movement restricting system in particular arrangements may include a latch structure for locking the support in its neutral position, and in a particular embodiment this latch structure includes an actuator member mounted on the grip portion for moving a latch member between a retracted position spaced from the support portion and an advanced position in which latch portions are inserted into recesses in the support portion to provide positive positioning of the support portion relative to the grip portion. The actuator member is manually operable between two stable positions and tends to be maintained in either of those positions by a spring member housed within the grip portion. In another embodiment the movement restricting system includes a control member movable to vary the moment arm of a biasing spring and hence to vary the imposed degree of movement restriction. In both such embodiments the bearing structure is compact and sturdy with restoring and control elements located between axially spaced bearing elements in an arrangement which accommodates different types of blade units and which provides convenient and efficient shaving.

The invention provides a sturdy and reliable shaving implement that is economical to manufacture and facilitates a dynamic mode of shaving action in which the active portions of the shaving system tend to conform to the skin surface during the shaving stroke.

Other objects, features and advantages will be seen as the following description of particular embodiments progresses, in conjunction with the drawings, in which.

DESCRIPTION OF PARTICULAR EMBODIMENTS

Figure 1:
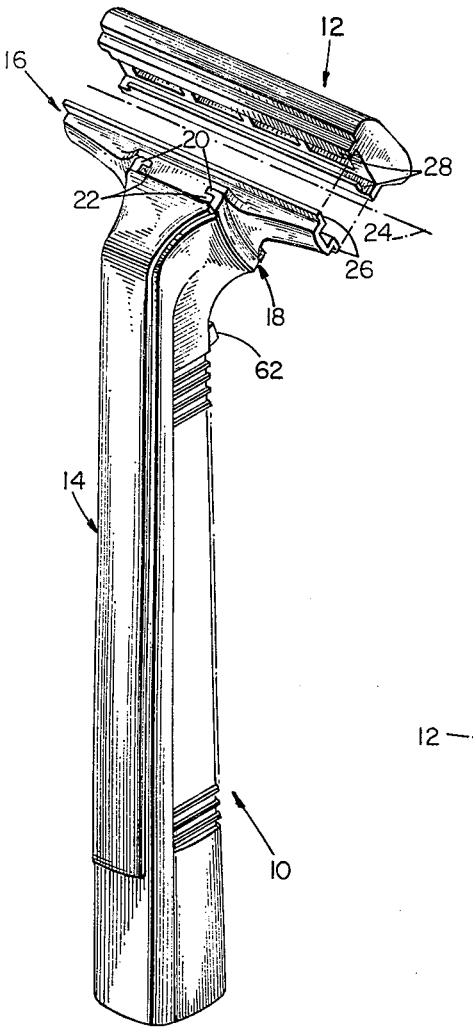
FIG. 1 is a perspective view of a shaving implement in accordance with the invention.

The shaving system shown in FIG. 1 includes a handle component 10 and a blade unit component 12. The handle component includes an elongated grip portion 14 that is of generally square cross-sectional configuration with a slight taper along its axial length. At the upper end of the grip portion is a transversely extending support portion 16 and disposed between grip portion 14 and support portion 16 is a connector portion 18 that includes cooperating interengaged arcuate bearing elements 20, 22 that permit movement of support portion 16 relative to grip portion 14 along an axis 24 that is spaced beyond support portion 16 and extends parallel thereto.

Support portion 16 has outwardly directed flange or rail portions 26 which receive grooves 28 in the base of blade unit 12 to secure that blade unit to the support portion in manner similar to the razor handle coupling arrangement shown in Perry U.S. Pat. No. 3,768,162. A variety of types of blade units may be secured to the handle component, including for example the several types of blade units shown in the above-mentioned Perry patent.

Figure 2:
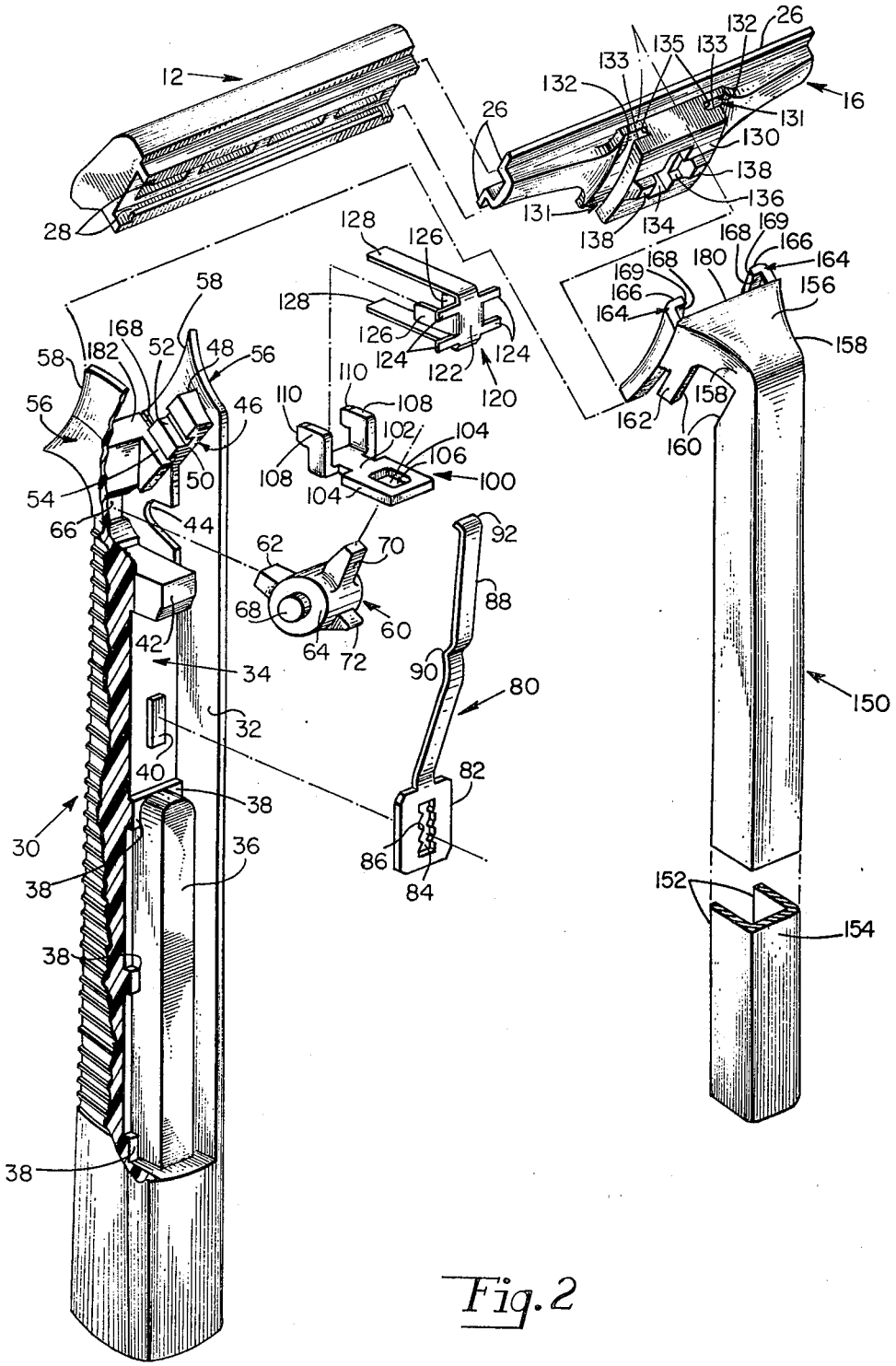
FIG. 2 is a perspective exploded view of components of the shaving implement shown in FIG. 1.

Additional details of a first embodiment of the handle component may be seen with reference to the exploded view in FIG. 2. That handle component includes a grip portion 30 molded of high impact polystyrene that includes spaced side wall portions 32 which define recess 34. An elongated upstanding projection 36 is provided in recess 34 and a series of stop surfaces 38 are provided between projection 36 and each adjacent side wall 32. A second projection 42 is provided in recess 34 adjacent its upper end and a rectangular boss 40 is located between projections 36 and 42. Formed in each side wall above projection 42 is a socket structure 44 and an aligning structure 46. Each structure 46 has parallel front and rear walls 48, 50 and grooves or slots 52 and 54 extend through it. Above structure 46, the side walls 32 flare outwardly as indicated at 56 to arcuate end surfaces 58.

Lever component 60 of molded plastic is adapted to be mounted within recess 34. Lever 60 includes a handle portion 62 which projects radially from body 64 and is adapted to pass through opening 66 in grip 30; stub shafts 68 which project from either side of body 62 and are adapted to be received in sockets 44; and further radial projections 70 and 72.

A second component housed within grip portion 30 is a phosphor bronze latch spring 80 that includes a base portion 82 in which an aperture 84 is formed that has inwardly projecting teeth 86 that are sized to bite into boss 40 so that the spring strip 80 may be firmly secured on that boss; a narrow elongated spring portion 88 that has an offset 90; and a curved tip portion 92.

A third component is a lock member 100 that includes a body portion 102 with parallel edges 104 and an aperture 106. At the forward end of body 102 are two upstanding spaced apart arms 108 and each arm has a forwardly extending latch portion 110.

A fourth component is a phosphor bronze biasing spring 120 which includes a base 122; four securing tabs 124 that project laterally from the base; two locating tabs 126 that project forwardly from the sides of base 122; and two longer spring tabs 128 that project forwardly from the top and bottom edges of base 122, spring tabs 128 being about ½ inch in length and about three times as long as locating tabs 126.

Support member 16 is molded of high impact polystyrene and includes integral rails 26 that extend the four-centimeter transverse length of the support member and a coupling portion 130 about one centimeter in length. Formed in each side wall of coupling portion 130 is an arcuate bearing element 22 in the form of groove 131 which has a radius of about one cm. and a width of about one mm. and a length of about one centimeter. Groove 131 defines juxtaposed inner and outer arcuate bearing surfaces 132, 133 and a base surface 135. Formed in the base of coupling portion 130 are a main recess 134 of rectangular configuration that receives the ends of spring tabs 128; a latch recess 136 on either side of the main recess 134; and two stop projections 138, each positioned outwardly of a latch recess 136.

Back member 150 is formed of one millimeter gauge brass stock and includes two elongated side flanges 152 connected together by a back portion 154. The upper end 156 of back portion 154 is bent forwardly and the upper ends of side flanges 152 flare outwardly at 158. Formed in each flared portion 158 is a recess that has parallel side walls 160, and a projecting tab 162 forward of the recess. At the upper end of each flared portion is formed a cooperating bearing element 20 in the form of an arcuate flange portion or hollow shaft segment 164, the inner and outer surfaces 166, 168 of which are adapted to be received in bearing exgagement with outer and inner bearing segments 132, 133 of the grooves 132 of support member 16 and end surfaces 169 of which thrust bearing engagement with base surfaces 135 of grooves 132.

Figure 3:
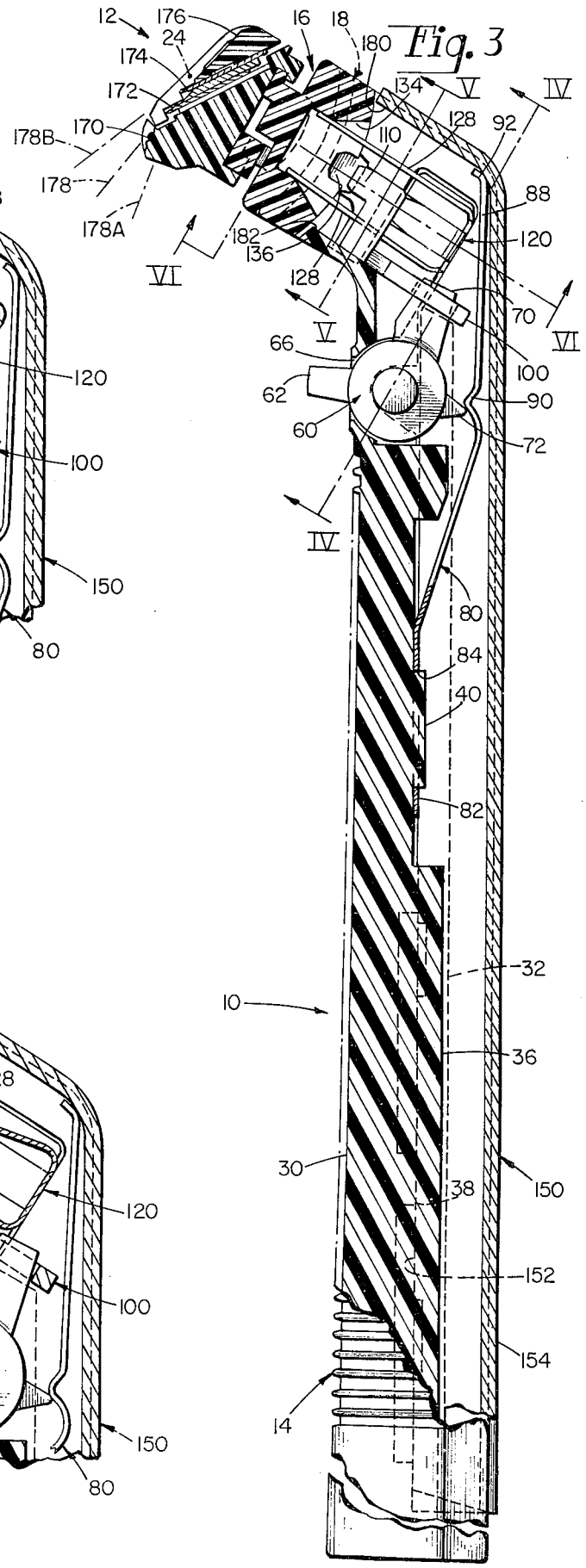
FIG. 3 is a side elevational view with parts broken away of the shaving implement shown in FIG. 1.
Figure 4:
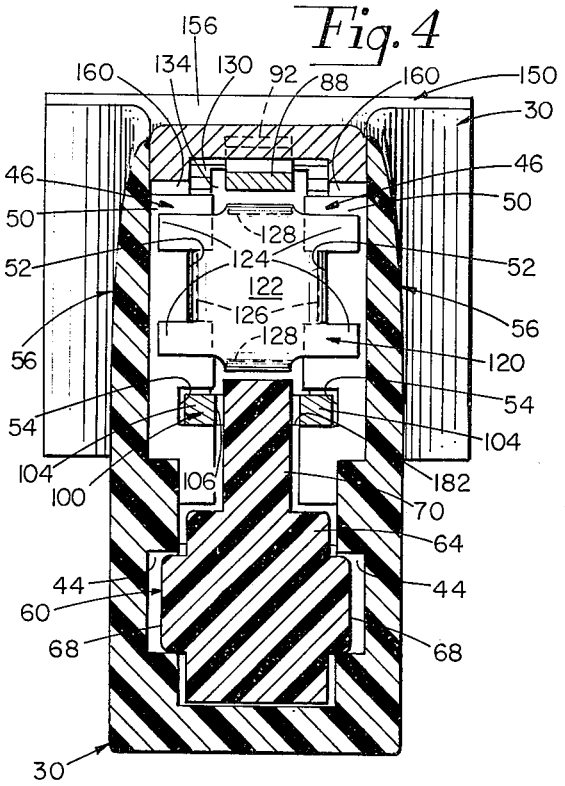
FIGS. 4–6 are sectional views taken along the lines 4—4, 5—5 and 6—6, respectively, of FIG. 3.
Figure 5:
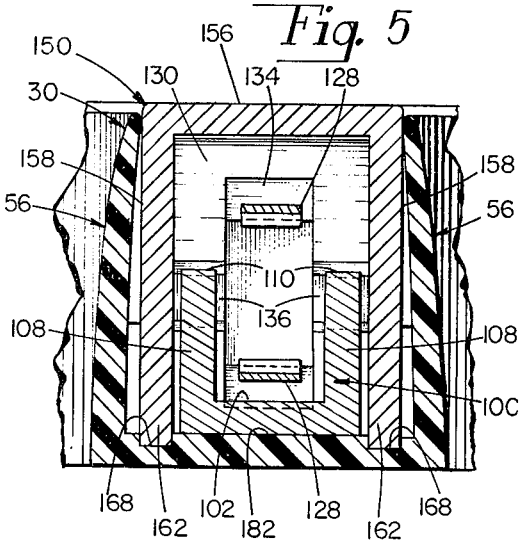
Figure 6:
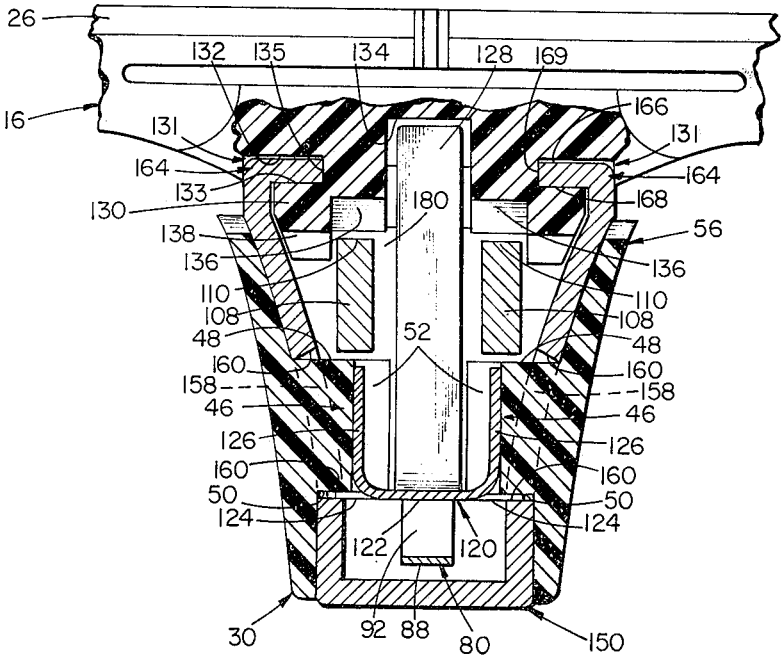

In assembly, grip 30 and support member 16 are positioned in a fixture, so both parts are located as they would be on the final assembly (unlocked and in neutral position — FIG. 6). The remaining parts are installed from the back of the grip. Lock member 100 is inserted into grip 30 with edge portions 104 disposed in grooves 54 as indicated in FIG. 4. Lever 60 is then inserted in recess 44 of handle with projection 70 inverted in slot 106 of lock member 102. Spring tabs 126 are slid onto grooves 52 until tabs 124 seat against wall 50 of projection 46; and the base of spring 80 is then pressed onto boss 40 and held firmly by serrations 86. The last member to be assembled is the back 150 which is assembled by engaging lower portion of bearing flange tongues 164 with the upper portions of cooperating bearing grooves 132. Member 150 is then swung downwards about the bearing axis 24, further engaging the bearing surfaces until tabs 162 seat in recesses 168 immediately forward of surfaces 148 and side flanges 152 bottom out against stops 138 on either side of projection 36. In this position as indicated in FIG. 3, lateral tabs 124 of spring 120 are secured against the rear surface of boss 46 by recess walls 160; depending tabs 162 are seated in grip recesses 168; the forward ends of spring tabs 128 are fully inserted in recess 134 and flexed toward one another as indicated in FIGS. 3 and 5; and spring 80 is flexed, by engagement of its upper end 92 with the inner surface of back 150, into firm engagement with latch projection 72. FIG. 6 shows, in section, the interengagement of arcuate bearing flanges shows, in section, the interengagement of arcuate bearing segments 132, 133 and shaft segment surfaces 166, 168; and thrust bearing surfaces 135, 169.

The assembled razor is shown with a replaceable blade unit 12 in position on rails 26 in FIG. 3. In that position it will be noted that pivot axis 24 as defined by the cooperation of back member flanges 164 and support member grooves 132 is slightly above but immediately adjacent the cutting edge of trailing blade member 174 of the attached blade unit 120.

Figure 7:
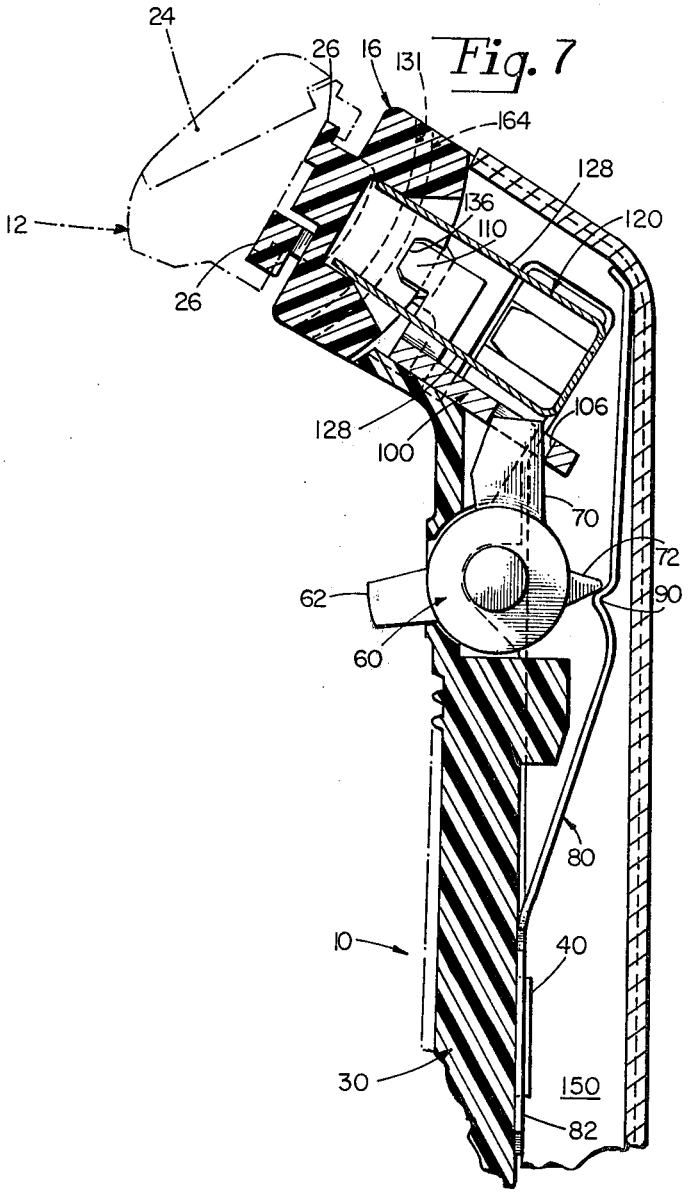
FIG. 7 is a sectional view similar to FIG. 3 showing the implement in latched or rigid condition.

In a first stable position as shown in FIG. 3 projections 110 of lock member 100 are retracted from recesses 136. Depressing handle 62 of actuator 60 slides lock member 100 forward. Projection 72 is snapped past spring projection 90 into a second stable position and lock projections 110 are inserted into latch recesses 136, as shown in FIG. 7. In this position the support member 16 is fixed in position relative to grip 10 and the shaving implement may be used in conventional manner, there being a rigid interconnection between the grip and the support member so that the blade elements 172, 174 and cooperating guard and. cap structure 170, 176 are positioned in fixed relation to the grip.

The shaving implement may be used in flexible mode merely by rotating the actuator handle 62 upward to its other stable position (FIG. 3), withdrawing the latch projection 110 and permitting stable arcuate movement of support member 16 relative to grip 10 about axis 24 as defined by engaged bearing surfaces 20, 22. Spring tabs 128 provide a light biasing force to position the support member 16 into the normal or neutral position, those tabs being both slightly flexed inwardly towards one another in this position in a balanced configuration so that each provides a restoring force on the support member.

Figure 8:
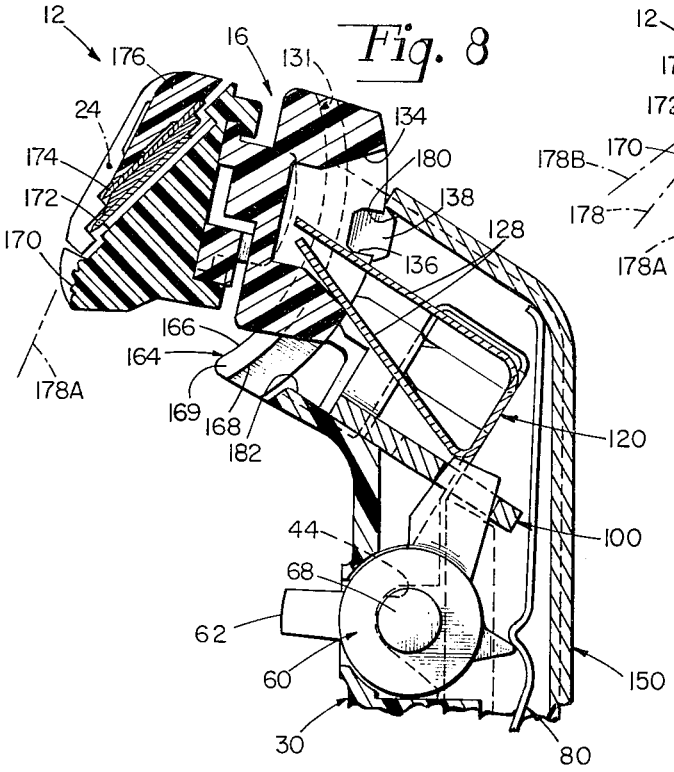
FIGS. 8 and 9 are sectional views similar to FIG. 3 showing the position of the system in two positions of maximum rotation.
Figure 9:
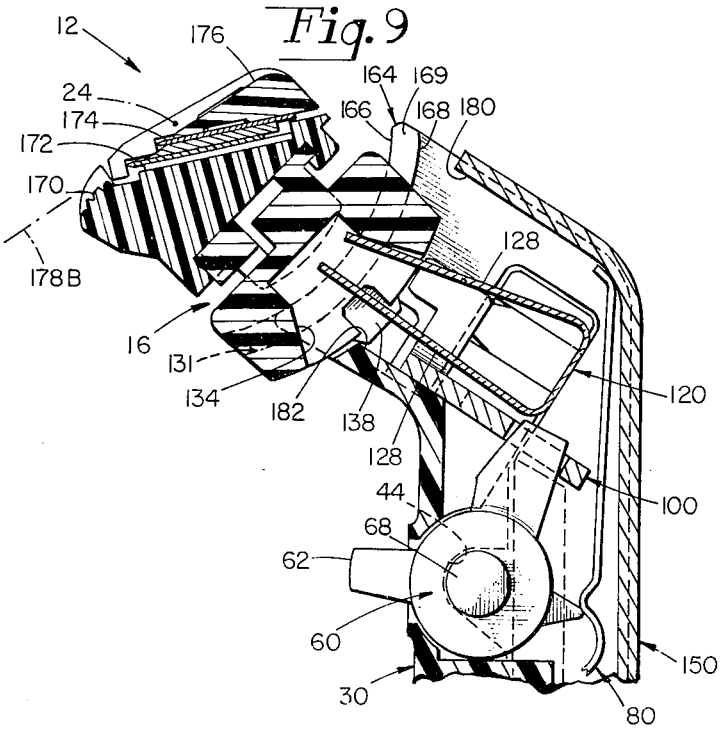

With the shaving implement in this flexible mode configuration, the active elements of the shaving system, e.g. the blades 172, 174 and cooperating leading and following guard surfaces 170, 176, are permitted to align themselves as a unit with the configuration of the skin surface being shaved, so that the shaving system dynamically follows the contour of the skin surface during a shaving stroke independently of the position of the razor grip. Thus the implement permits a dynamic conformity of the active shaving elements to that skin surface and promotes increased shaving effectiveness and efficiency. In this embodiment, the shaving plane 178 (defined by surfaces 170, 176) is allowed to swing in either direction relative to grip 14 through an angle of about 15° between the position indicated in FIG. 3 by planes 178A and 178B, the engagement of projections 138 with back surface 180 providing a limit in one direction, as shown in FIG. 8 (plane 178A); and projections 138 in engagement with grip surface 180 providing a limit on motion in the other direction, as shown in FIG. 9 (plane 178B). As the shaving plane 178 departs from the neutral position, one of the spring tabs 128 is further stressed and imposes a restoring force that returns the blade unit 12 to its normal position upon release of the angular force imposed by the shaving operation.

Thus, in this embodiment there is provided a shaving implement which may be used in a fixed (standard) or a dynamic mode in accordance with the shaver's preference. In the dynamic mode of operation the active shaving elements move relative to the grip about a pivot axis. The pivot axis is defined by a compact shell bearing structure that houses restoring spring structure, and that pivot axis is located immediately adjacent but preferably in or slightly above shaving plane 178. Smooth relative movement is provided over the range of movement and the restoring spring structure continuously imposes a light restoring force that tends to return the shaving unit to its normal relationship relative to the grip.

Figure 10:
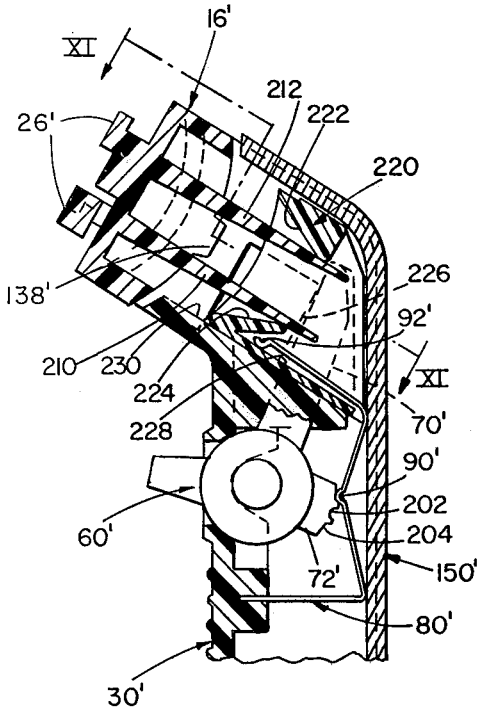
FIG. 10 is a sectional side view of a second embodiment of a shaving implement in accordance with the invention.
Figure 11:
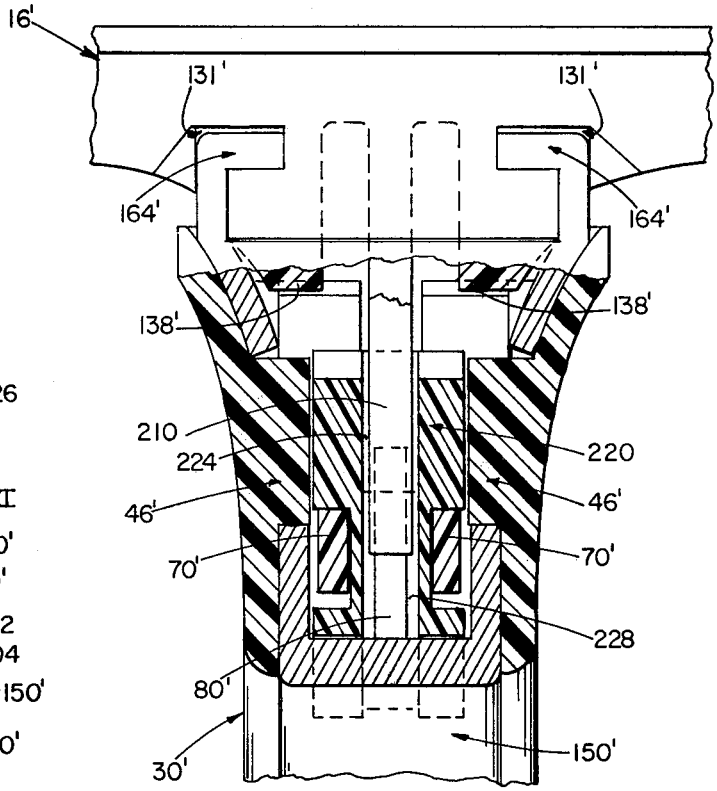
FIG. 11 is a sectional view taken along the line 11—11 of FIG. 10.

Details of a second embodiment may be seen with reference to FIGS. 10 and 11. That embodiment includes a grip portion 30' in which an actuator lever 60' is journalled. Back component 150' secures strip spring 80' in position with projection 90' urged against lever projection 72' which has a series of latch recesses 200, 202 and 204. A similar support portion 16' is secured to arcuate bearing flanges 164' of the back member 150'. Support portion 16' has similar coupling flange portions 26' that are adapted to engage coupling grooves of a suitable blade unit.

Figure 12:
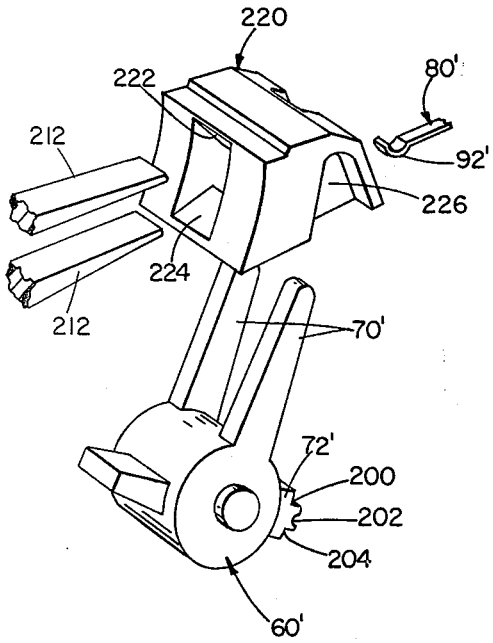
FIG. 12 is a perspective view of components of the shaving implement shown in FIG. 10.

Formed integrally with support portion 16' are resilient spring webs 210, 212 which extend rearwardly between the bearing elements 20', 22'. Housed within the grip at the upper end thereof is a flexing control member 220 that is guided for reciprocation by side wall projections 46' toward and away from support portion 16' within grip 30'. Member 220, as indicated in FIG. 12, is of generally rectangular configuration and has a passage extending through it from front to rear. Upper and lower control surfaces 222, 224 are formed at the forward end of the passage. Recesses 226 in the side walls of member 220 receive lever projections 70'. The upper end 92' of spring 80' engages the lower surface 228 of the control member passage and biases member 220 down against upper surface 230 of the grip. Rotational movement of the lever 60' in the counterclockwise direction in FIG. 10 moves control member 220 forward along webs 210, 212 towards support member 16'.

Figure 13:
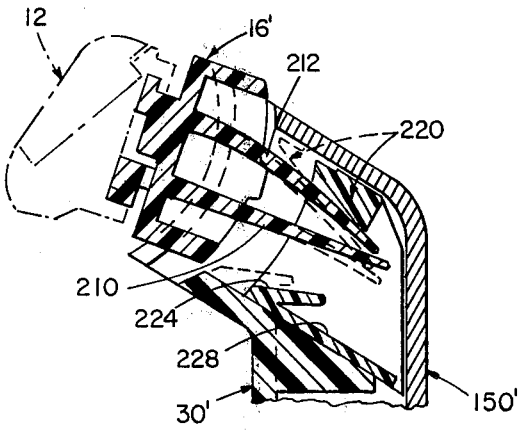
FIG. 13 is a sectional view similar to FIG. 10 showing the relation of components of the system in shifted positions.

In this embodiment, spring webs 210, 212 engage control surfaces 222, 224 and are flexed inwardly towards one another so that each web provides a low magnitude restoring force on the support member 16' in the normal or neutral position shown in FIG. 10. During a shaving stroke, the shell bearing structure allows the active elements in the shaving system to align themselves as a unit with the configuration of the skin surface being shaved, independently of the position of the razor grip, as in the embodiment shown in FIGS. 1–9. The allowed rotation of shaving surfaces about axis 24' in either direction is limited by stop projections 138'. As the support portion is arcuately displaced, as indicated in FIG. 13, one of the spring webs (e.g. 212) is further stressed and imposes increased restoring force which tends to return the support portion 16' to its normal position upon release of the angular force imposed by the shaving operation.

A range of resistances to the dynamic action is obtained by adjustment of lever 60'. Thus, as lever 60' is rotated in the clockwise direction, control member 220 is slid towards support portion 16', as indicated in FIG. 13, shortening the effective length of the spring webs 210, 212, and increasing the resistance to angular motion, making the shaving implement a stiffer device while retaining advantages of the dynamic motion of the system. Web 212 as it is bent contacts web 210 and thus resistance to further angular motion is provided by web 210 as well as augmented resistance due to the shorter moment arm of web 212 as indicated in dashed lines in FIG. 13. It will be apparent that the control member 220 could be employed to lock the system in a forward position, as well as providing a range of restriction values to the movement of support portion 16'.

While the illustrated shaving implement embodiments employ a replaceable blade unit having tandem blade elements, it will be apparent that the invention may be utilized in a variety of other wet shaving implement configurations including configurations in which the blade elements are not replaceable and the entire shaving implement is discardable, and configurations in which only the blade elements are replaceable. Further, various mechanisms may be employed for providing differing amounts of movement restriction, including arrangements in which frictional resistance is varied; as well as other motion control arrangements, other biasing structure arrangements, and other grip-support coupling arrangements in particular embodiments. Therefore it is not intended that the invention be limited to the disclosed embodiments or to details thereof and departures may be made therefrom within the spirit and scope of the invention as defined in the claims.

We claim:

1. A shaving implement comprising a grip portion, a transversely extending support portion at one end of said grip portion, said support portion defining a blade edge position, a connection between said grip portion and said support portion mounting said support portion for angular rotational movement relative to said grip portion during the course of a shaving stroke in a dynamic mode of shaving action about an axis extending transversely of said support portion parallel to and adjacent to said blade edge position, said connection including structure in said transversely extending support portion defining said axis at a point spaced further from said grip portion than portions of said transversely extending support portion, and structure for restricting the movement of said support portion relative to said grip portion, said movement restricting structure including a control portion movable between a first position which affords significant restriction of angular rotational movement and a second position which affords less restriction of angular rotational movement.

2. The implement as claimed in claim 1 wherein said connection between said support portion and said grip portion includes a tongue and groove coupling at each end of said transversely extending support portion.

3. The implement as claimed in claim 1 wherein said control portion is supported on said grip portion for reciprocable movement towards and away from said support portion along a path perpendicular to said axis.

4. The implement as claimed in claim 1 and further including restoring structure for generating a force when said support portion is offset from a position of neutral orientation relative to said grip portion tending to move said support portion towards said position of neutral orientation.

5. The implement as claimed in claim 1 and further including biasing structure tending to maintain said support portion in preferred orientation relative to said grip portion.

6. The implement as claimed in claim 5 wherein said biasing structure includes a leaf spring portion extending between grip portion and said support portion, and further including stop structure for limiting the relative movement of said support portion relative to said grip portion.

7. A shaving implement comprising a grip portion, a transversely extending support portion at one end of said grip portion, a connection between said grip portion and said support portion which permits movement of said support portion relative to said grip portion during the course of a shaving stroke in a dynamic mode of shaving action, two leaf spring members providing two opposed restoring forces tending to maintain said support portion in preferred orientation relative to said grip portion where said restoring forces are balanced, and structure for restricting the movement of said support portion relative to said grip portion, said movement restricting structure including a control portion movable between a first position which affords significant movement restriction and a second position which affords less movement restriction.

8. The implement as claimed in claim 1 wherein said movement restricting structure includes an actuator member carried by said grip portion and said control portion is responsive to said actuator member and movable between a first position and a second position further from said support portion.

9. The implement as claimed in claim 8 wherein said actuator member is mounted for rotational movement and further including a cooperating spring member for stably maintaining said actuator member in either said first position or said second position.

10. A shaving implement comprising a grip portion, a transversely extending support portion at one end of said grip portion, said support portion defining a blade edge position, a connection between said grip portion and said support portion mounting said support portion for angular rotational movement relative to said grip portion about an axis extending transversely of said support portion parallel to and immediately adjacent to said blade edge position during the course of a shaving stroke in a dynamic mode of shaving action, and structure for restricting the movement of said support portion relative to said grip portion, said movement restricting structure including an actuator member carried by said grip portion and a control portion responsive to said actuator member and movable between a first position which affords significant restriction of angular rotational movement and a second position which affords less restriction of angular rotational movement, said control portion in said first position being inserted into a recess in said support portion for locking said support portion relative to said grip portion.

11. The implement as claimed in claim 1 and further including restoring structure for generating a force when said support portion is offset from a position of neutral orientation relative to said grip portion tending to move said support portion towards said position of neutral orientation and wherein said control portion cooperates with said restoring structure to provide different restoring forces in said first and second positions.

12. A shaving implement comprising a grip portion, a transversely extending support portion at one end of said grip portion, a connection between said grip portion and said support portion which permits movement of said support portion relative to said grip portion during the course of a shaving stroke in a dynamic mode of shaving action, said connection including juxtaposed, spaced, inner and outer, arcuate bearing segments, each said bearing segment being less than 180° in angular extent, and a cooperating hollow shaft segment also of less than 180° in angular extent, the inner and outer surfaces of said hollow shaft segment being received in bearing engagement with said inner and outer bearing segments, said interengaged bearing segments and shaft segment defining an axis of rotation of said support portion located immediately adjacent the active elements of the shaving system and extending parallel to the cutting edge of the shaving implement and structure for restricting the movement of said support portion relative to said grip portion, said movement restricting structure including a control portion movable between a first position which affords significant movement restriction and a second position which affords less movement restriction.

13. The implement as claimed in claim 1 wherein said control portion in said first position locks said support portion relative to said grip portion.

14. The implement as claimed in claim 1 and further including restoring structure for generating a force when said support portion is offset from a position of neutral orientation relative to said grip portion tending to move said support portion towards said position of neutral orientation, said restoring structure including an elongated member extending between said grip and support portions, and said control portion being movable along a path generally parallel to said elongated member.

15. The implement as claimed in claim 14 wherein said restoring structure includes biasing structure tending to maintain said support portion in preferred orientation relative to said grip portion.

16. The implement as claimed in claim 15 wherein said biasing structure includes two leaf spring members for providing two opposed restoring forces tending to maintain said support portion in a normal position where said restoring forces are balanced.

17. A shaving implement comprising a grip portion, a transversely extending support portion at one end of said grip portion, said support portion defining a blade edge position, a connection between said grip portion and said support portion mounting said support portion for angular rotational movement relative to said grip portion about an axis extending transversely of said support portion parallel to and immediately adjacent to said blade edge position during the course of a shaving stroke in a dynamic mode of shaving action, restoring structure for generating a force when said support portion is offset from a position of neutral orientation relative to said grip portion tending to move said support portion towards said position of neutral orientation, said restoring structure including two elongated spring members for providing two opposed restoring forces tending to maintain said support portion in a normal position where said restoring forces are balanced, said elongated spring members extending between said grip and support portions, and structure for restricting the movement of said support portion relative to said grip portion, said movement restricting structure including a control portion movable along a path generally parallel to said elongated members between a first position which affords significant restriction of angular rotational movement and a second position which affords less restriction of angular rotational movement, an actuator member carried by said grip portion and mounted for rotational movement, a cooperating spring member for stably maintaining said actuator in a selected position, said control portion being responsive to said actuator member and said second position being spaced further from said support portion than said first position.

18. The implement as claimed in claim 17 wherein said connection includes coupling elements of arcuate configuration, so that at least about one quarter of the total length of said support portion projects outwardly of the bearing elements, the axes of the arcs of said coupling elements being coincident and located in the immediate vicinity of the active elements of the shaving system and extending parallel to the cutting edge of the shaving system.

19. The implement as claimed in claim 18 wherein said support portion includes coupling structure for detachably mounting a blade unit.

20. The implement as claimed in claim 17 wherein said connection includes juxtaposed, spaced, inner and outer, arcuate bearing segments, each said bearing segment being less than 180° in angular extent, and a cooperating hollow shaft segment also of less than 180° in angular extent, the inner and outer surfaces of said hollow shaft segment being received in bearing engagement with said inner and outer bearing segments, said interengaged bearing segments and shaft segment defining an axis of rotation of said support portion located immediately adjacent the active elements of the shaving system and extending parallel to the cutting edge of the shaving system.

* * * * *